US009748653B1

(12) United States Patent
Yang et al.

(10) Patent No.: US 9,748,653 B1
(45) Date of Patent: Aug. 29, 2017

(54) MULTILAYER CHIP ANTENNA

(71) Applicant: ACX Corporation, Hsinchu County (TW)

(72) Inventors: Wei-Ren Yang, Kaohsiung (TW); Wei-Jen Lee, Zhubei (TW); Jyh-Wen Sheen, Zhubei (TW)

(73) Assignee: ACX CORPORATION (TW)

( * ) Notice: Subject to any disclaimer, the term of this patent is extended or adjusted under 35 U.S.C. 154(b) by 37 days.

(21) Appl. No.: 15/084,481

(22) Filed: Mar. 30, 2016

(51) Int. Cl.
*H01Q 1/38* (2006.01)
*H01Q 9/04* (2006.01)
*H01Q 1/48* (2006.01)

(52) U.S. Cl.
CPC ..... *H01Q 9/0414* (2013.01); *H01Q 1/48* (2013.01)

(58) Field of Classification Search
CPC ..... H01Q 1/48; H01Q 9/0414
USPC ..... 343/700 MS
See application file for complete search history.

*Primary Examiner* — Graham Smith

(57) ABSTRACT

Differing from conventionally-used miniature cubic antenna being provided with a signal transceiving conductor on the outer surface thereof, the present invention provides a multilayer chip antenna formed by sequentially stacking a first coupling substrate, a signal transceiving metal layer, and a second coupling substrate. Particularly, the first coupling substrate and the second coupling substrate are disposed with a first metal layer and a second metal layer, respectively. Therefore, when the signal transceiving metal layer transmits or receives a wireless signal, not only a first coupling capacitor is induced between the signal transceiving metal layer and the first metal layer, but also a second coupling capacitor is simultaneously induced between the signal transceiving metal layer and the third metal layer; meanwhile, the first and second coupling capacitors are helpful to enhance the impedance bandwidth as the multilayer chip antenna transmits and/or receives a high-frequency wireless signal.

24 Claims, 9 Drawing Sheets

MULTILAYER CHIP ANTENNA

BACKGROUND OF THE INVENTION

1. Field of the Invention

The present invention relates to the technology field of micro antenna, and more particularly to a multilayer chip antenna having internal capacitive loads.

2. Description of the Prior Art

Nowadays, communication products are designed to have light weight and compact size with the development of science and technology, such that the electronics devices or components must be miniaturized for integrated into the corresponding communication products. Antenna is an essential component for a wireless communication product, wherein planar inverted-F printed antenna (PIFA) is widely applied in various wireless communication products because having miniaturization characteristics.

Please refer to FIG. 1, which illustrates a framework view of a conventional planar inverted-F printed antenna. As FIG. 1 shows, conventionally-used planar inverted-F printed antenna 1*a* mainly consists of: a grounding layer 11*a* and a patch metal layer 12*a*, wherein the patch metal layer 12*a* is connected to the grounding layer 11*a* by a grounding portion 121*a* thereof. When applying the planar inverted-F printed antenna 1*a*, a feeding pin 122*a* is electrically connected to the patch metal layer 12*a*, so as to use the planar inverted-F printed antenna 1*a* to transceiver wireless signal. For example, the planar inverted-F printed antenna 1*a* is able to transceiver the wireless signal with 2.45 GHz frequency when the summation of length and width of the planar inverted-F printed antenna 1*a* is designed to 30 mm (i.e., one fourth (¼) of wavelength).

However, with the advancement of communication technology, the conventional planar inverted-F printed antenna 1*a* reveals some shortcomings and drawbacks in practical application. The shortcomings and drawbacks are as follows:

(1) It needs to pre-arrange an antenna installing region on the main board of the communication product (such as a cell phone) for facilitating the planar inverted-F printed antenna 1*a* be integrated onto the main board easily; however, the antenna installing region limits the miniaturization of the communication product;

(2) Moreover, since the transmission frequency characteristic of the inverted-F antenna 1*a* is dependent on the length and width summation of the patch metal layer 12*a*, it can easily know that the miniaturization of the inverted-F antenna 1*a* is bound to affect the antenna characteristics including transmission bandwidth and antenna efficiency.

In order to provide a solution for communication products' miniaturization, miniature antennas are developed and proposed. Please refer to FIG. 2, which illustrates a stereo view of a miniature cubic antenna. As FIG. 2 shows, the miniature cubic antenna 1' disposed on an antenna installing region 20' of a circuit board 2' consists of: a cubic body 11', a first conductive layer 12', a signal transmitting layer 13', a second conductive layer 14', a signal feeding layer 15', and a grounding layer 16'. In which, the conductive layer 12', the signal transmitting layer 13' and the second conductive layer 14' are disposed on the top surface of the cubic body 11', and the signal feeding layer 15' is disposed on one side surface of the cubic body 11' for connecting with the second conductive layer 14'.

As shown in FIG. 2, a large range of grounding electrode 22' is arranged to surround the antenna installing region 20'. In addition, the grounding electrode 22' has a connecting portion 221' extending into the antenna installing region 20' for connecting with the grounding layer 16'. Moreover, a signal feeding electrode 23' is provided in the antenna installing region 20', used for inputting signal into the signal feeding layer 15' of the miniature cubic antenna 1'.

When applying the miniature cubic antenna 1', an inductive effect would occur between the first conductive layer 12' and the second conductive layer 14', and the impedance bandwidth of the miniature cubic antenna 1' for transmitting high-frequency signal is therefore increased due to the occurrence of the inductive effect. Simultaneously, a coupling capacitor would be produced between the grounding layer 16' and the signal transmitting layer 13', and the coupling capacitor facilitates the inductor produced between the first conductive layer 12' and the second conductive layer 14' electrically couple to the grounding electrode 22' through the grounding layer 16'; therefore, the imaginary impedance of the inductor produced between the first conductive layer 12' and the second conductive layer 14' is eliminated.

Despite the miniature cubic antenna 1' shows the advantages of high impedance bandwidth for transmitting high-frequency signal and being able to be miniaturized, inventors of the present invention find that the miniature cubic antenna 1' still shows some shortcomings and drawbacks in practical application. The shortcomings and drawbacks are as follows:

(A) The miniature cubic antenna 1' mainly uses the signal transmitting layer 13' to transceiver wireless signal, so that any other conductive layers and/or electrodes cannot be disposed in the antenna installing region 20'. However, such prohibition limits the miniaturization of the communication product having the miniature cubic antenna 1'.

Thus, since both the conventionally-used planar inverted-F printed antenna 1*a* and miniature cubic antenna 1' shows shortcomings and drawbacks in practical application, the inventors of the present application have made great efforts to make inventive research thereon and eventually provided a multilayer chip antenna having internal capacitive loads.

SUMMARY OF THE INVENTION

The primary objective of the present invention is to provide a multilayer chip antenna having internal capacitive loads. Differing from conventionally-used miniature cubic antenna being provided with a signal transceiving conductor on the outer surface thereof, this novel multilayer chip antenna is formed by sequentially stacking a first coupling substrate, a signal transceiving metal layer, and a second coupling substrate. Particularly, the first coupling substrate and the second coupling substrate are disposed with a first metal layer and a second metal layer, respectively. Therefore, when the signal transceiving metal layer transmits or receives a wireless signal, not only a first coupling capacitor is induced between the signal transceiving metal layer and the first metal layer, but also a second coupling capacitor is simultaneously induced between the signal transceiving metal layer and the third metal layer; meanwhile, the first and second coupling capacitors are helpful to enhance the impedance bandwidth as the multilayer chip antenna transmits and/or receives a high-frequency wireless signal.

In order to achieve the primary objective of the present invention, the inventor of the present invention provides a first embodiment of the multilayer chip antenna, comprising: a main body, comprising:

a first coupling substrate, provided with a first metal layer on the surface thereof;

a signal transmitting substrate, stacked on the first coupling substrate and provided with a second metal layer on the surface thereof; and a second coupling substrate, stacked on the signal transmitting substrate and provided with a third metal layer on the surface thereof;

a feeding electrode, disposed on a first side surface of the main body for electrically connecting with the second metal layer of the signal transmitting substrate;

a first grounding electrode, disposed on a second side surface of the main body for electrically connecting with the first metal layer of the first coupling substrate; wherein the second side surface and the first side surface are two opposing surfaces; and a second grounding electrode, disposed on the second side surface of the main body for electrically connecting with the third metal layer of the second coupling substrate;

wherein when the multilayer chip antenna transmits a wireless signal, a first coupling capacitor being produced between the second metal layer and the first metal layer; and simultaneously, a second coupling capacitor being produced between the second metal layer and the third metal layer.

Moreover, for achieving the primary objective of the present invention, the inventor of the present invention provides a second embodiment of the multilayer chip antenna, comprising:

a main body, comprising:

a supporting substrate;

a first coupling substrate, provided with a first metal layer on the surface thereof;

a signal transmitting substrate, stacked on the first coupling substrate and provided with a second metal layer on the surface thereof;

a second coupling substrate, stacked on the signal transmitting substrate and provided with a third metal layer on the surface thereof; and a covering substrate, being stacked on the second coupling substrate and provided with a remark pattern on the surface thereof;

a feeding electrode, disposed on a first side surface of the main body for electrically connecting with the second metal layer of the signal transmitting substrate;

a first grounding electrode, disposed on a second side surface of the main body for electrically connecting with the first metal layer of the first coupling substrate; wherein the second side surface and the first side surface are two opposing surfaces; and a second grounding electrode, disposed on the second side surface of the main body for electrically connecting with the third metal layer of the second coupling substrate;

wherein when the multilayer chip antenna transmits a wireless signal, a first coupling capacitor being produced between the second metal layer and the first metal layer; and simultaneously, a second coupling capacitor being produced between the second metal layer and the third metal layer.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe a multilayer chip antenna having internal capacitive loads according to the present invention, embodiments of the present invention will be described in detail with reference to the attached drawings hereinafter.

First Embodiment

Figure 3A:
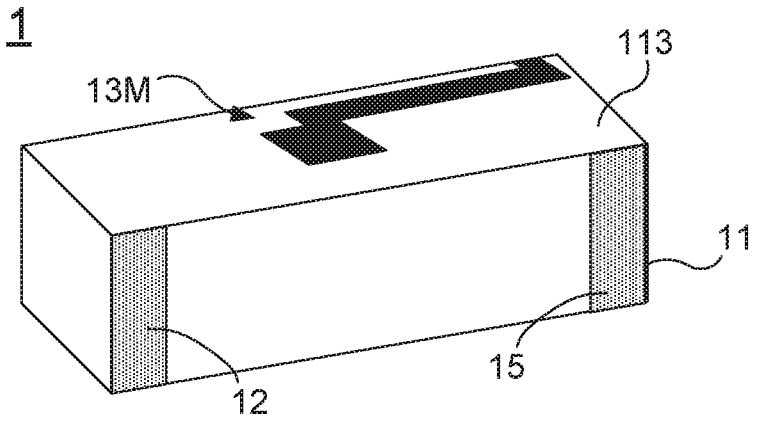
FIG. 3A, FIG. 3B, and FIG. 3C show stereo diagrams of a multiplayer chip antenna according to a first embodiment of the present invention.
Figure 3B:
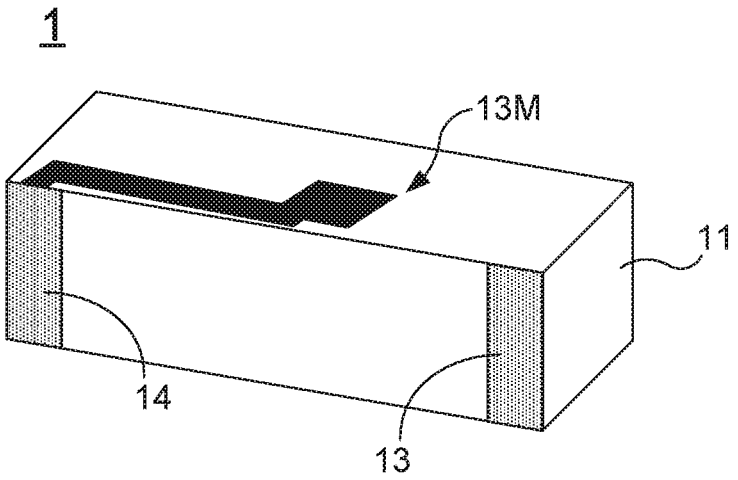
Figure 3C:
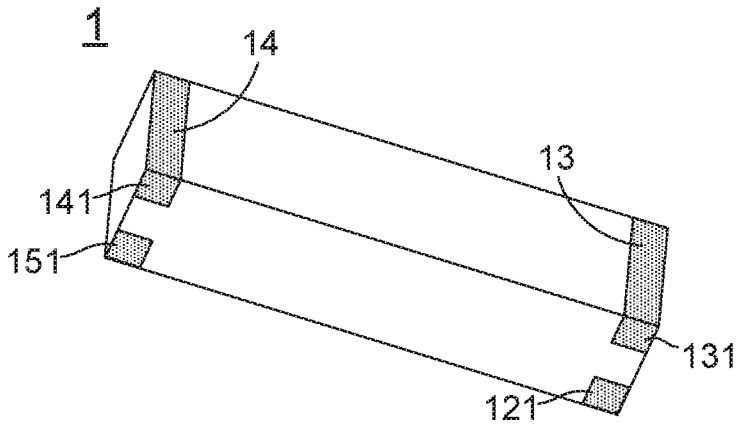

Please refer to FIG. 3A, FIG. 3B and FIG. 3C, where stereo diagrams of a multiplayer chip antenna according to the first embodiment of the present invention are provided. As shown in FIG. 3A, FIG. 3B and FIG. 3C, the first embodiment of the multilayer chip antenna having capacitive loads mainly induces: a main body 11, a feeding electrode 12, a first grounding electrode 13, a second grounding electrode 14, and a redundancy electrode 15. Please simultaneously refer to FIG. 4, which illustrates an exploded view of the main body. In the present invention, the main body 11 is fabricated by sequentially stacking a first coupling substrate 111, a signal transmitting substrate 112 and a second coupling substrate 113.

As the attached figures show, the first coupling substrate 111, the signal transmitting substrate 112 and the second coupling substrate 113 are made of ceramic materials. In addition, a first metal layer 11M is disposed on the surface of the first coupling substrate 111, and consists of: a first extension segment 11M1, a first electrically-transmitting segment 11M2 connected with the first extension segment 11M1 by one end thereof, a second extension segment 11M3 connected with the other end of the first electrically-transmitting segment 11M2, and first metal plate 11M4 connected with the second extension segment 11M3. Moreover, In first metal layer 11M, the first extension segment 11M1 is orthogonal to the first electrically-transmitting segment 11M2, and the second extension segment 11M3 is also orthogonal to the first electrically-transmitting segment 11M2.

In addition, a second metal layer 12M is disposed on the surface of the signal transmitting substrate 112, and consists of: a third extension segment 12M1, a second electrically-transmitting segment 12M2 connected with the third extension segment 12M1 by one end thereof, and a second metal plate 12M4 connected with the other end of the second electrically-transmitting segment 12M2. Moreover, a third metal layer 13M is disposed on the surface of the second coupling substrate 113, and consists of: a fourth extension segment 13M1, a third electrically-transmitting segment 13M2 connected with the fourth extension segment 13M1 by one end thereof, a fifth extension segment 13M3 connected with the other end of the third electrically-transmitting segment 13M2, and a third metal plate 13M4 connected with the fifth extension segment 13M3. Moreover, In third metal layer 13M, the fourth extension segment 13M1 is orthogonal to the second electrically-transmitting segment 13M2, and the fifth extension segment 13M3 is also orthogonal to the second electrically-transmitting segment 13M2.

In the present invention, the feeding electrode 12 is disposed on a first side surface of the main body 11 for electrically connecting with the second metal layer 12M of the signal transmitting substrate 112. In addition, the first grounding electrode 13 is disposed on a second side surface of the main body 11 for electrically connecting with the first metal layer 11M of the first coupling substrate 111, wherein the second side surface and the first side surface are two opposing surfaces. Moreover, a first welding electrode 131 is formed on the bottom surface of the first coupling substrate 111 for connecting with the first grounding electrode 13. On the other hand, the second grounding electrode 14 is disposed on the second side surface of the main body 11 for electrically connecting with the third metal layer 13M of the second coupling substrate 113, and a second welding electrode 141 is formed on the bottom surface of the first coupling substrate 111 for connecting with the second grounding electrode 14. Besides, the redundancy electrode 15 is disposed on the first side surface of the main body 11, and a fourth welding electrode 151 is formed on the bottom surface of the first coupling substrate 111 for connecting with the redundancy electrode 15.

Figure 4:
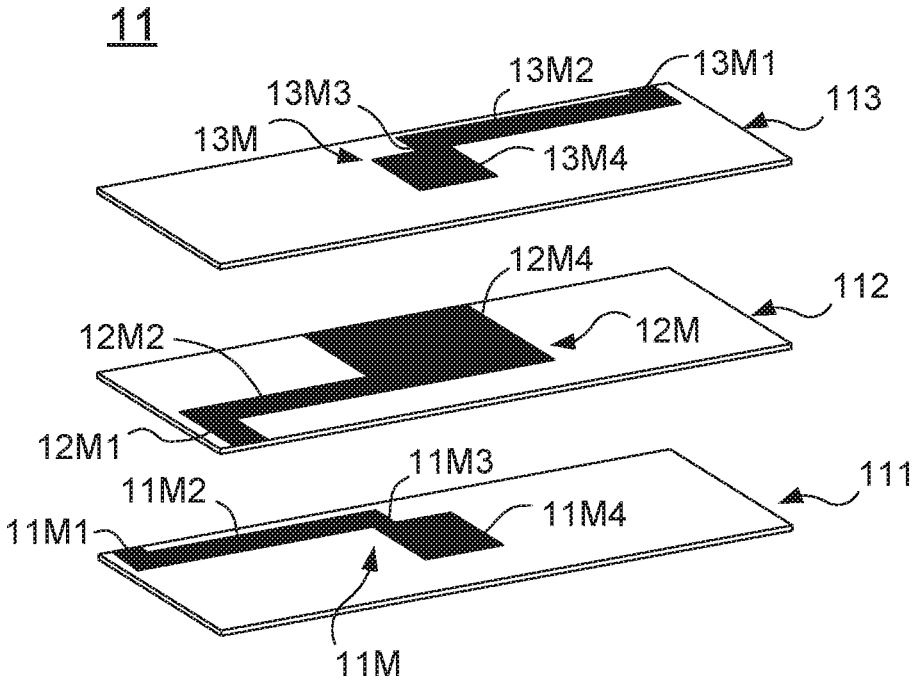
FIG. 4 shows an exploded view of a main body of the multiplayer chip antenna.
Figure 5:
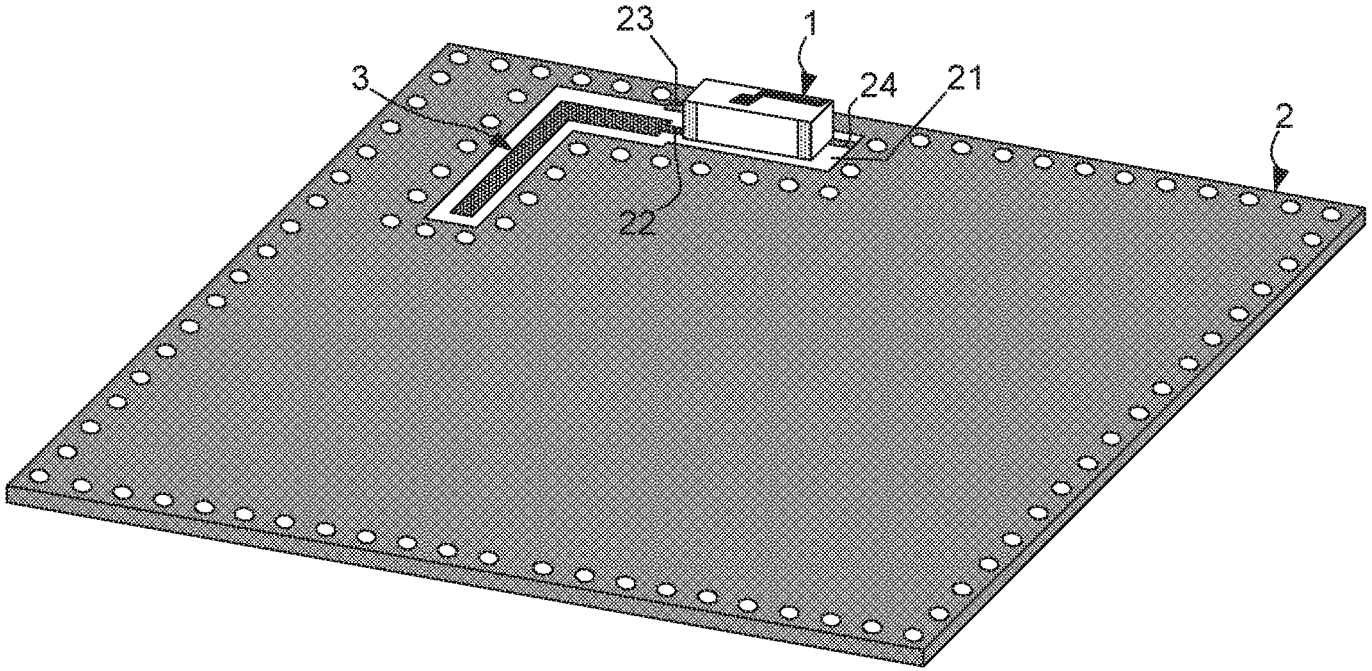
FIG. 5 shows a schematic application diagram of the multiplayer chip antenna provided by the present invention.

Continuously referring to FIG. 3A, FIG. 3B, FIG. 3C, and FIG. 4, and please simultaneously refer to FIG. 5, which shows a schematic application diagram of the multiplayer chip antenna 1 provided by the present invention. As the attached figures show, because there has the first welding electrode 131, the second welding electrode 141 and the third welding electrode 121 being formed on the bottom surface of the first coupling substrate 111, the multilayer chip antenna 1 of the present invention can be easily integrated on an antenna installing region 21 of a main board 2 through welding process. Moreover, it is worth further explaining that, an antenna engineer can arrange a feeding conductive wire 3 having a welding pad 22 in the antenna installing region 21, such that the multilayer chip antenna 1 is able to electrically connect with the feeding conductive wire 3 by welding the third welding electrode 121 of the feeding electrode 12 with the welding pad 22. In addition, the antenna engineer can also arrange a first grounding pad 23 and a second grounding pad 24 in the antenna installing region 21 for respectively electrically connecting with the first welding electrode 131 of the first grounding electrode 13 and the second welding electrode 141 of the second grounding electrode 14 through welding process.

Particularly, because the second metal layer 12M for transceiving wireless signal is buried between the first coupling substrate 111 and the second coupling substrate 113, the first grounding pad 23 and the second grounding pad 24 disposed in the antenna installing region 21 are limited on affecting the antenna efficiency of the multilayer chip antenna 1 of the present invention. Moreover, in this novel multilayer chip antenna 1, the first metal plate 11M4 indirectly overlaps the second metal plate 12M4 through the signal transmitting substrate 112; moreover, the third metal plate 13M4 also indirectly overlapping the second metal plate 12M4 through the second coupling substrate 113. By such particular design, when the multilayer chip antenna 1 transmits a wireless signal, a first coupling capacitor is produced between the second metal layer 12M and the first metal layer 11M, and a second coupling capacitor is simultaneously produced between the second metal layer 12M and the third metal layer 13M. So that, the impedance bandwidth of the multilayer chip antenna 1 for transmitting high-frequency signal is therefore increased because the multilayer chip antenna 1 includes internal capacitive loads.

In order to make the first coupling capacitor and the second coupling capacitor become the best capacitive load, as shown in FIG. 4, the size of the first metal plate 11M4 is smaller than the size of the second metal plate 12M4; moreover, the size of the third metal plate 13M4 is smaller than the size of the second metal plate 12M4. However, FIG. 4 does not used for limiting the embodiments of the metal plates (11M4, 12M4, 13M4). In practicable application, the size of the first metal plate 11M4 can also be larger than the size of the second metal plate 12M4; and similarly, the size of the third metal plate 13M4 can also be larger than the size of the second metal plate 12M4.

Second Embodiment

Figure 6A:
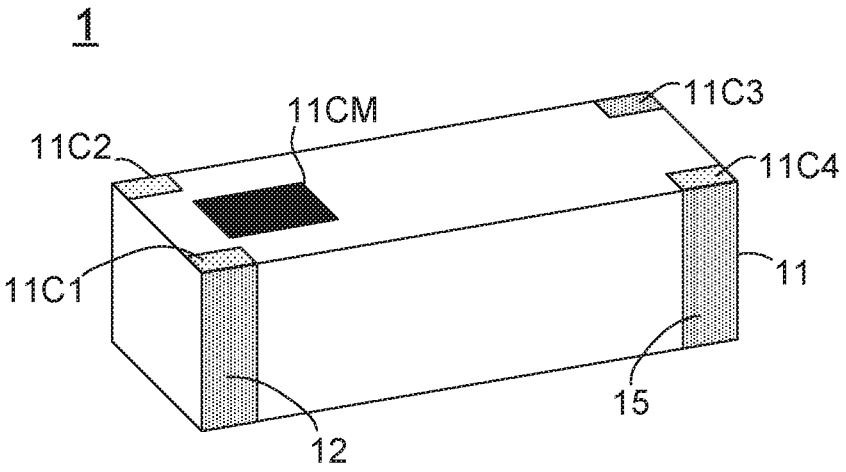
FIG. 6A, FIG. 6B, and FIG. 6C show stereo diagrams of the multiplayer chip antenna according to a second embodiment of the present invention.
Figure 6B:
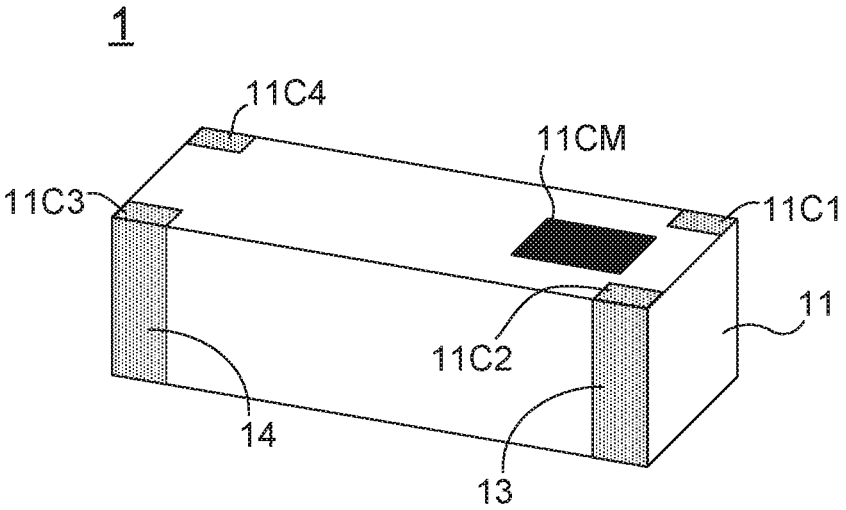
Figure 6C:
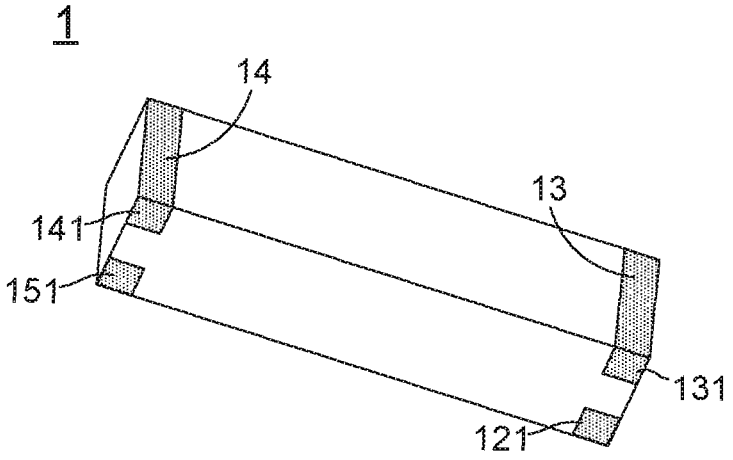
Figure 7:
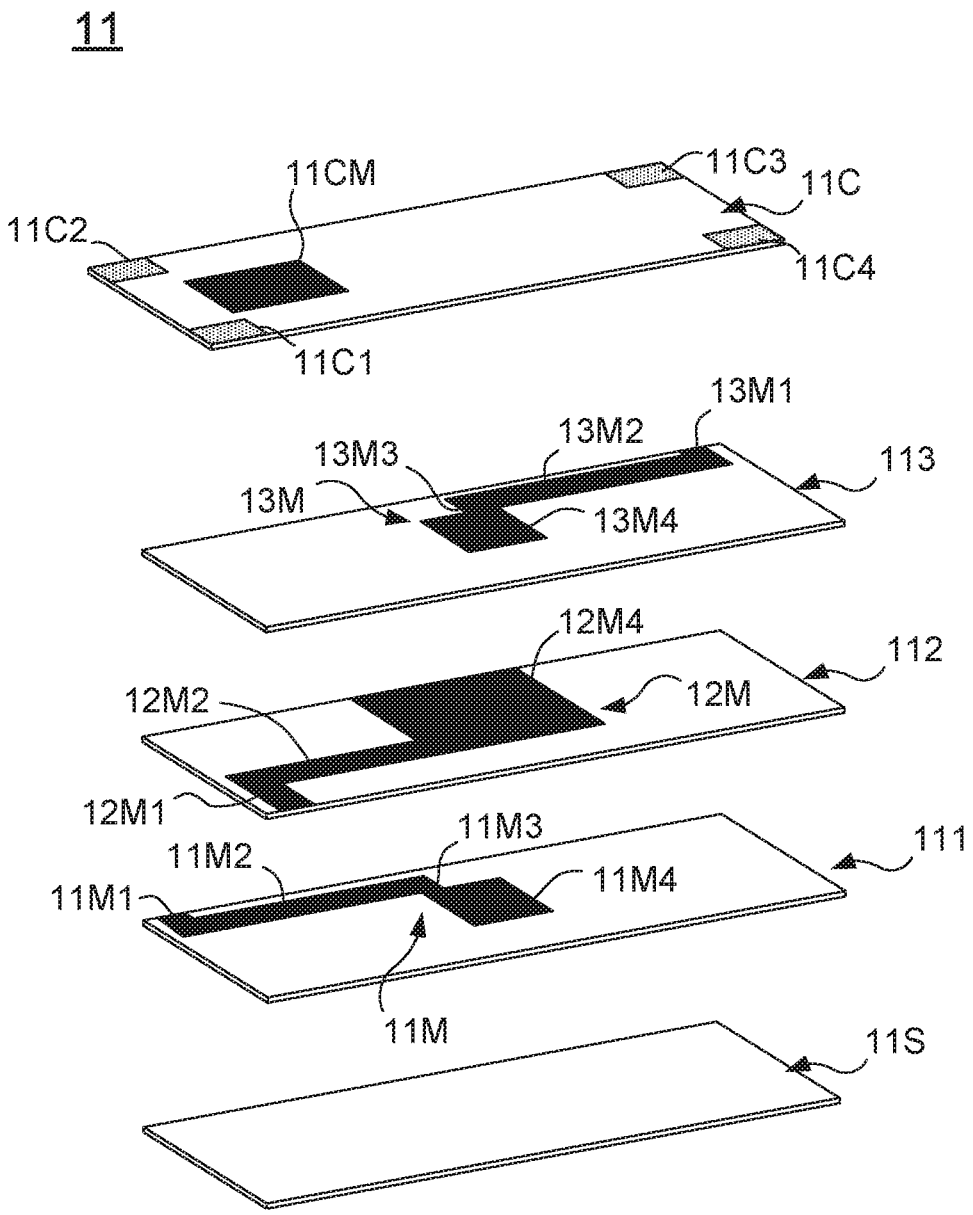
FIG. 7 shows an exploded view of the main body of the multiplayer chip antenna.
Figure 8:
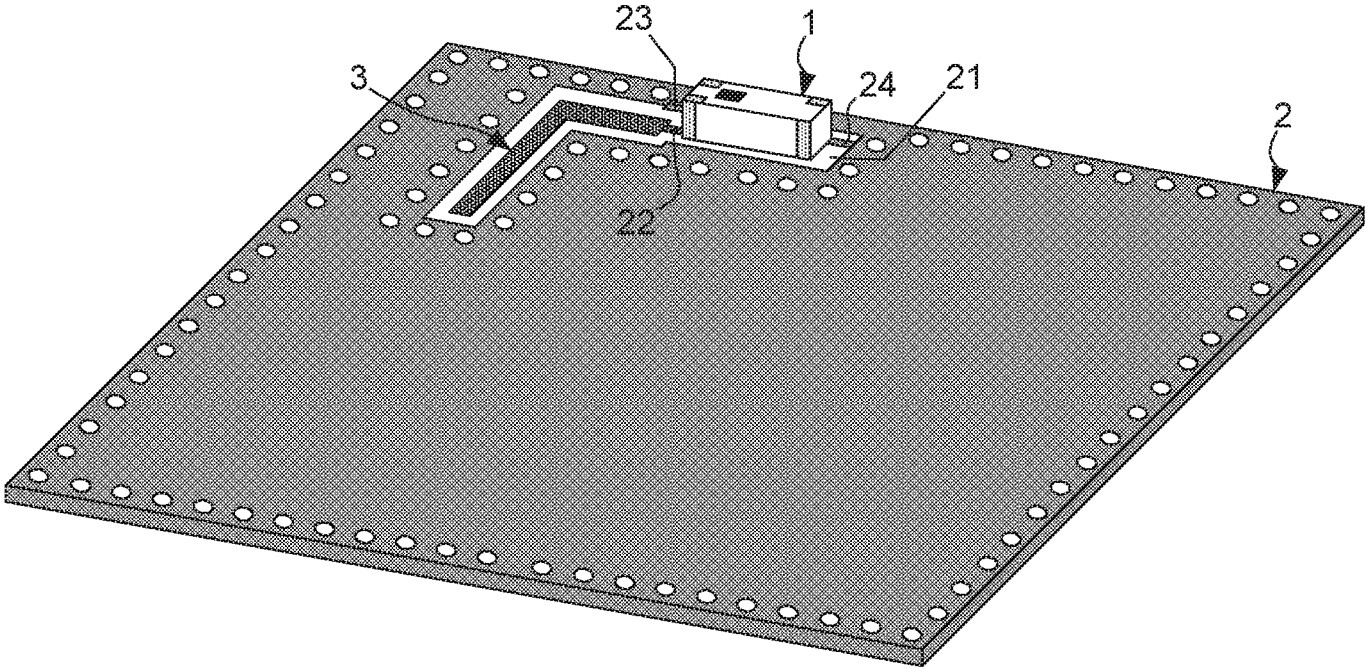
FIG. 8 shows a schematic application diagram of the multiplayer chip antenna of the second embodiment.

Please refer to FIG. 6A, FIG. 6B and FIG. 6C, where stereo diagrams of a multiplayer chip antenna according to the second embodiment of the present invention are provided. As shown in FIG. 6A, FIG. 6B and FIG. 6C, the first embodiment of the multilayer chip antenna 1 having capacitive loads mainly induces: a main body 11, a feeding electrode 12, a first grounding electrode 13, a second grounding electrode 14, and a redundancy electrode 15. Please simultaneously refer to FIG. 7, which illustrates an exploded view of the main body. In the second embodiment of the multilayer chip antenna 1, the main body 11 is fabricated by sequentially stacking a supporting substrate 11S, a first coupling substrate 111, a signal transmitting substrate 112, a second coupling substrate 113, and a covering substrate 11C. Moreover, the covering substrate 11C is provided with a remark pattern 11CM on the surface thereof, used for judging the direction of the multilayer chip antenna 1.

As the attached figures show, the supporting substrate 11S, the first coupling substrate 111, the signal transmitting substrate 112, the second coupling substrate 113, and the covering substrate are made of ceramic materials. In addition, a first welding electrode 131, a second welding electrode 141, a third welding electrode 121, and a fourth welding electrode 151 are disposed on the bottom surface of the supporting substrate for connecting with the first grounding electrode 13, the second grounding electrode 14, the feeding electrode 12, and the redundancy electrode 15, respectively. On the other hand, the top surface of the covering substrate 11C is provided with a fifth welding electrode 11C1, a six welding electrode 11C2, a seventh welding electrode 11C3, and an eighth welding electrode 11C4 thereon, and the fifth welding electrode 11C1, the six welding electrode 11C2, the seventh welding electrode 11C3, and the eighth welding electrode 11C4 respectively connecting with the feeding electrode 12, the first grounding electrode 13, the second grounding electrode 14, and the redundancy electrode 15.

Continuously referring to FIG. 6A, FIG. 6B, FIG. 6C, and FIG. 7, and please simultaneously refer to FIG. 5, which shows a schematic application diagram of the second embodiment of the multiplayer chip antenna 1. As the attached figures show, because there has the first welding electrode 131, the second welding electrode 141 and the third welding electrode 121 being formed on the bottom surface of the first coupling substrate 111, the multilayer chip antenna 1 of the present invention can be easily integrated on an antenna installing region 21 of a main board 2 through welding process. Moreover, because the second metal layer 12M for transceiving wireless signal is buried between the first coupling substrate 111 and the second coupling substrate 113, the first grounding pad 23 and the second grounding pad 24 disposed in the antenna installing region 21 are limited on affecting the antenna efficiency of the multilayer chip antenna 1 of the present invention.

In this novel multilayer chip antenna 1, the first metal plate 11M4 indirectly overlaps the second metal plate 12M4 through the signal transmitting substrate 112; moreover, the third metal plate 13M4 also indirectly overlapping the second metal plate 12M4 through the second coupling substrate 113. By such particular design, when the multilayer chip antenna 1 transmits a wireless signal, a first coupling capacitor is produced between the second metal layer 12M and the first metal layer 11M, and a second coupling capacitor is simultaneously produced between the second metal layer 12M and the third metal layer 13M. So that, the impedance bandwidth of the multilayer chip antenna 1 for transmitting high-frequency signal is therefore increased because the multilayer chip antenna 1 includes internal capacitive loads.

Figure 1:
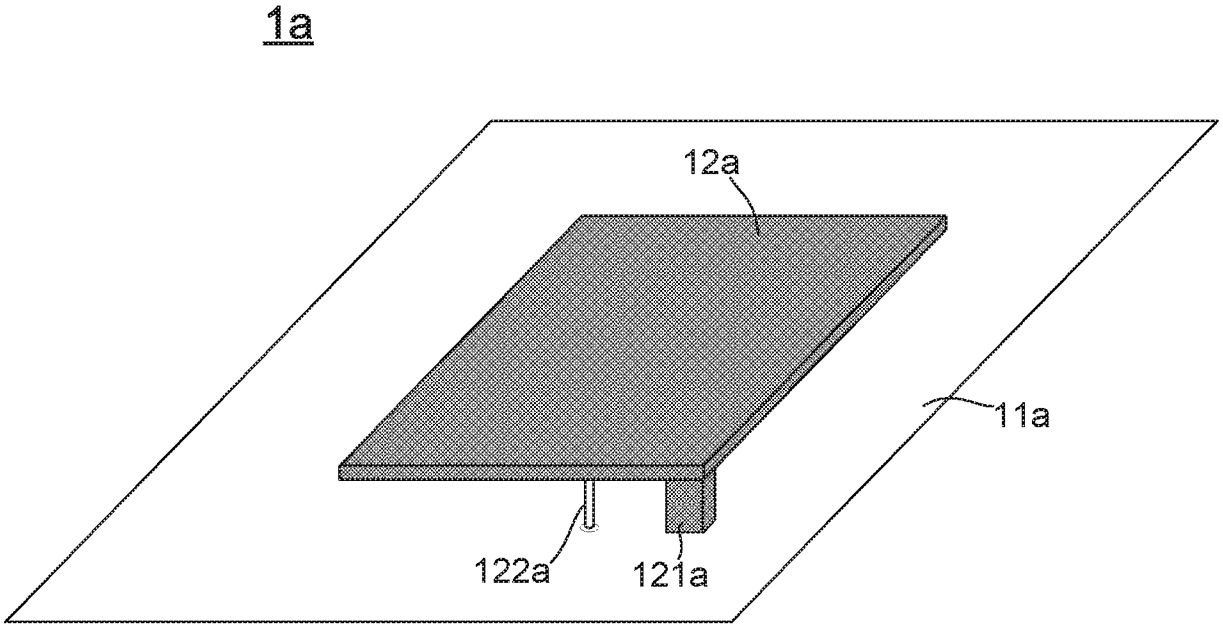
FIG. 1 (Prior art)
FIG. 1 shows a framework view of a conventional planar inverted-F printed antenna.
Figure 2:
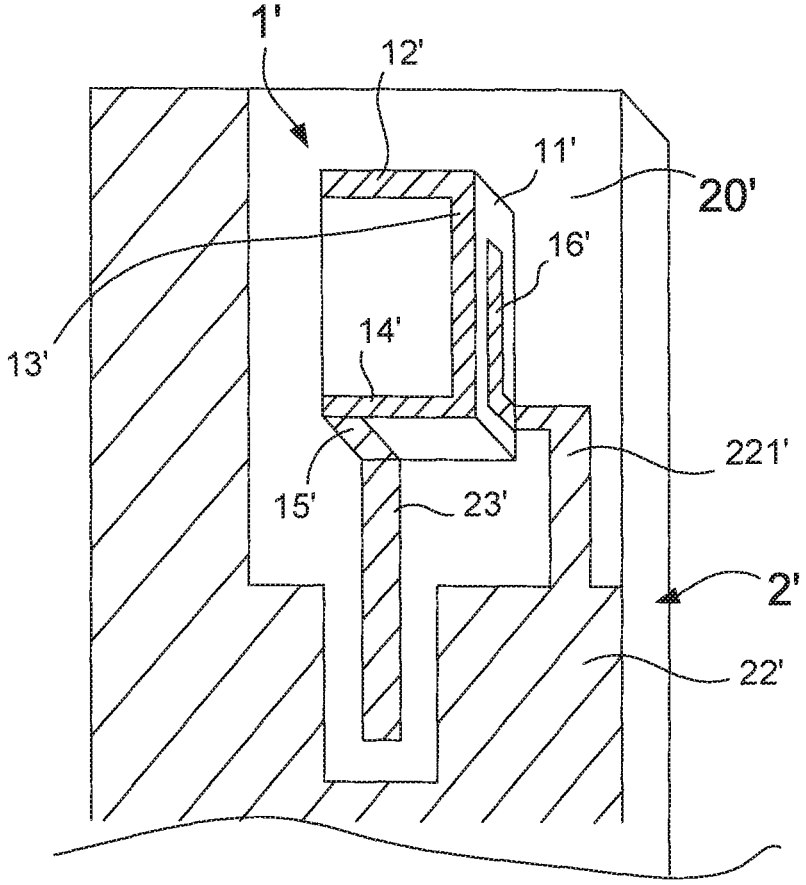
FIG. 2 (Prior art)
FIG. 2 shows a stereo view of a miniature cubic antenna.

Therefore, through above descriptions, the multilayer chip antenna provided by the present invention has been introduced completely and clearly; in summary, the present invention includes the advantages of:

(1) Differing from conventionally-used miniature cubic antenna 1' (as shown in FIG. 2) being provided with a signal transceiving conductor on the outer surface thereof, the present invention provides a multilayer chip antenna 1 formed by sequentially stacking a first coupling substrate 111, a signal transmitting substrate 112, and a second coupling substrate 113. Particularly, the first coupling substrate and the second coupling substrate are disposed with a first metal layer and a second metal layer, respectively. In the present invention, because the signal transceiving metal layer (i.e., the second metal layer 12M) is buried between the first coupling substrate 111 and the second coupling substrate 113, the electromagnetic interferences caused by a large range of grounding electrode arranged in the antenna installing region are limited on affecting the antenna efficiency of the multilayer chip antenna 1 of the present invention. Therefore, the antenna efficiency of the multilayer chip antenna 1 is enhanced.

(2) Moreover, in the present invention, the said first coupling substrate 111 and second coupling substrate 113 are respectively provided with a first metal layer 11M and a second metal layer 13M thereon. By such arrangement, when the multilayer chip antenna 1 transmits a wireless signal, a first coupling capacitor is produced between the second metal layer 12M and the first metal layer 11M, and a second coupling capacitor is simultaneously produced between the second metal layer 12M and the third metal layer 13M. So that, the impedance bandwidth of the multilayer chip antenna 1 for transmitting high-frequency signal is therefore increased because the multilayer chip antenna 1 includes internal capacitive loads.

The above description is made on embodiments of the present invention. However, the embodiments are not intended to limit scope of the present invention, and all equivalent implementations or alterations within the spirit of the present invention still fall within the scope of the present invention.

What is claimed is:

1. A multilayer chip antenna, comprising:

a main body 11, comprising:

a first coupling substrate 111, being provided with a first metal layer 11M on the surface thereof;

a signal transmitting substrate 112, being stacked on the first coupling substrate 111 and provided with a second metal layer 12M on the surface thereof; and a second coupling substrate 113, being stacked on the signal transmitting substrate 112 and provided with a third metal layer 13M on the surface thereof;

a feeding electrode 12, being disposed on a first side surface of the main body 11 for electrically connecting with the second metal layer 12M of the signal transmitting substrate 112;

a first grounding electrode 13, being disposed on a second side surface of the main body 11 for electrically connecting with the first metal layer 11M of the first coupling substrate 111; wherein the second side surface and the first side surface are two opposing surfaces; and a second grounding electrode 14, being disposed on the second side surface of the main body 11 for electrically connecting with the third metal layer 13M of the second coupling substrate 113;

wherein when the multilayer chip antenna 1 transmits a wireless signal, a first coupling capacitor being produced between the second metal layer 12M and the first metal layer 11M; and simultaneously, a second coupling capacitor being produced between the second metal layer 12M and the third metal layer 13M.

2. The multilayer chip antenna of claim 1, wherein the first coupling substrate 111, the signal transmitting substrate 112 and the second coupling substrate 113 are made of ceramic materials.

3. The multilayer chip antenna of claim 1, wherein a first welding electrode 131 is formed on the bottom surface of the first coupling substrate 111 for connecting with the first grounding electrode 13.

4. The multilayer chip antenna of claim 1, wherein the first metal layer 11M comprises:

a first extension segment 11M1, being disposed on the surface of the first coupling substrate 111;

a first electrically-transmitting segment 11M2, being disposed on the surface of the first coupling substrate 111 and connected with the first extension segment 11M1 by one end thereof;

a second extension segment 11M3, being disposed on the surface of the first coupling substrate 111 and connected with the other end of the first electrically-transmitting segment 11M2; and a first metal plate 11M4, being disposed on the surface of the first coupling substrate 111 and connected with the second extension segment 11M3.

5. The multilayer chip antenna of claim 3, wherein a second welding electrode 141 is formed on the bottom surface of the first coupling substrate 111 for connecting with the second grounding electrode 14.

6. The multilayer chip antenna of claim 4, wherein the second metal layer 12M comprises:

A third extension segment 12M1, being disposed on the surface of the signal transmitting substrate 112;

a second electrically-transmitting segment 12M2, being disposed on the surface of the signal transmitting substrate 112 and connected with the third extension segment 12M1 by one end thereof;

a second metal plate 12M4, being disposed on the surface of the signal transmitting substrate 112 and connected with the other end of the second electrically-transmitting segment 12M2.

7. The multilayer chip antenna of claim 5, wherein a third welding electrode 121 is formed on the bottom surface of the first coupling substrate 111 for connecting with the feeding electrode 12.

8. The multilayer chip antenna of claim 6, wherein the third metal layer 13M comprises:

A fourth extension segment 13M1, being disposed on the surface of the third coupling substrate 113;

a third electrically-transmitting segment 13M2, being disposed on the surface of the third coupling substrate 113 and connected with the fourth extension segment 13M1 by one end thereof;

a fifth extension segment 13M3, being disposed on the surface of the third coupling substrate 113 and connected with the other end of the third electrically-transmitting segment 13M2; and a third metal plate 13M4, being disposed on the surface of the third coupling substrate 113 and connected with the fifth extension segment 13M3.

9. The multilayer chip antenna of claim 7, further comprising a redundancy electrode 15, being disposed on the first side surface of the main body 11; moreover, a fourth welding electrode 151 is formed on the bottom surface of the first coupling substrate 111 for connecting with the redundancy electrode 15.

10. The multilayer chip antenna of claim 8, wherein the first metal plate 11M4 indirectly overlaps the second metal plate 12M4 through the signal transmitting substrate 112; moreover, the third metal plate 13M4 also indirectly overlapping the second metal plate 12M4 through the second coupling substrate 113.

11. The multilayer chip antenna of claim 8, wherein the size of the first metal plate 11M4 is larger or smaller than the size of the second metal plate 12M4; moreover, the size of the third metal plate 13M4 being larger or smaller than the size of the second metal plate 12M4.

12. A multilayer chip antenna, comprising:

a main body 11, comprising:

a supporting substrate 11S;

a first coupling substrate 111, being stacked on the supporting substrate 11S and provided with a first metal layer 11M on the surface thereof;

a signal transmitting substrate 112, being stacked on the first coupling substrate 111 and provided with a second metal layer 12M on the surface thereof;

a second coupling substrate 113, being stacked on the signal transmitting substrate 112 and provided with a third metal layer 13M on the surface thereof; and a covering substrate 11C, being stacked on the second coupling substrate 113;

a feeding electrode 12, being disposed on a first side surface of the main body 11 for electrically connecting with the second metal layer 12M of the signal transmitting substrate 112;

a first grounding electrode 13, being disposed on a second side surface of the main body 11 for electrically connecting with the first metal layer 11M of the first coupling substrate 111; wherein the second side surface and the first side surface are two opposing surfaces; and a second grounding electrode 14, being disposed on the second side surface of the main body 11 for electrically connecting with the third metal layer 13M of the second coupling substrate 113;

wherein when the multilayer chip antenna 1 transmits a wireless signal, a first coupling capacitor being produced between the second metal layer 12M and the first metal layer 11M; and simultaneously, a second coupling capacitor being produced between the second metal layer 12M and the third metal layer 13M.

13. The multilayer chip antenna of claim 12, wherein the supporting substrate 11S, the first coupling substrate 111, the signal transmitting substrate 112, the second coupling substrate 113, and the covering substrate are made of ceramic materials.

14. The multilayer chip antenna of claim 12, wherein the covering substrate 11C is provided with a remark pattern 11CM on the surface thereof.

15. The multilayer chip antenna of claim 12, wherein a first welding electrode 131 is formed on the bottom surface of the supporting substrate 11S for connecting with the first grounding electrode 13.

16. The multilayer chip antenna of claim 12, wherein the first metal layer 11M comprises:

a first extension segment 11M1, being disposed on the surface of the first coupling substrate 111;

a first electrically-transmitting segment 11M2, being disposed on the surface of the first coupling substrate 111 and connected with the first extension segment 11M1 by one end thereof;

a second extension segment 11M3, being disposed on the surface of the first coupling substrate 111 and connected with the other end of the first electrically-transmitting segment 11M2; and a first metal plate 11M4, being disposed on the surface of the first coupling substrate 111 and connected with the second extension segment 11M3.

17. The multilayer chip antenna of claim 15, wherein a second welding electrode 141 is formed on the bottom surface of the supporting substrate 11S for connecting with the second grounding electrode 14.

18. The multilayer chip antenna of claim 16, wherein the second metal layer 12M comprises:

a third extension segment 12M1, being disposed on the surface of the signal transmitting substrate 112;

a second electrically-transmitting segment 12M2, being disposed on the surface of the signal transmitting substrate 112 and connected with the third extension segment 12M1 by one end thereof;

a second metal plate 12M4, being disposed on the surface of the signal transmitting substrate 112 and connected with the other end of the second electrically-transmitting segment 12M2.

19. The multilayer chip antenna of claim 17, wherein a third welding electrode 121 is formed on the bottom surface of the supporting substrate 11S for connecting with the feeding electrode 12.

20. The multilayer chip antenna of claim 18, wherein the third metal layer 13M comprises:

a fourth extension segment 13M1, being disposed on the surface of the third coupling substrate 113;

a third electrically-transmitting segment 13M2, being disposed on the surface of the third coupling substrate 113 and connected with the fourth extension segment 13M1 by one end thereof;

a fifth extension segment 13M3, being disposed on the surface of the third coupling substrate 113 and connected with the other end of the third electrically-transmitting segment 13M2; and a third metal plate 13M4, being disposed on the surface of the third coupling substrate 113 and connected with the fifth extension segment 13M3.

21. The multilayer chip antenna of claim 19, further comprising a redundancy electrode 15, being disposed on the first side surface of the main body 11; moreover, a fourth welding electrode 151 is formed on the bottom surface of the supporting substrate 11S for connecting with the redundancy electrode 15.

22. The multilayer chip antenna of claim 20, wherein the first metal plate 11M4 indirectly overlaps the second metal plate 12M4 through the signal transmitting substrate 112; moreover, the third metal plate 13M4 also indirectly overlapping the second metal plate 12M4 through the second coupling substrate 113.

23. The multilayer chip antenna of claim 20, wherein the size of the first metal plate 11M4 is larger or smaller than the size of the second metal plate 12M4; moreover, the size of the third metal plate 13M4 being larger or smaller than the size of the second metal plate 12M4.

24. The multilayer chip antenna of claim 21, wherein the top surface of the covering substrate 11C is provided with a fifth welding electrode 11C1, a six welding electrode 11C2, a seventh welding electrode 11C3, and an eighth welding electrode 11C4 thereon, and the fifth welding electrode 11C1, the six welding electrode 11C2, the seventh welding electrode 11C3, and the eighth welding electrode 11C4 respectively connecting with the feeding electrode 12, the first grounding electrode 13, the second grounding electrode 14, and the redundancy electrode 15.

* * * * *